United States Patent [19]

Fawcett et al.

[11] Patent Number: 4,692,758

[45] Date of Patent: Sep. 8, 1987

[54] LEGIBILITY ENHANCEMENT FOR ALPHANUMERIC DISPLAYS

[75] Inventors: Bradley W. Fawcett, Byron; Lee A. Sendelbach, Rochester, both of Minn.

[73] Assignee: International Business Machines Corporation, Armonk, N.Y.

[21] Appl. No.: 595,770

[22] Filed: Apr. 2, 1984

[51] Int. Cl.[4] ..... G09G 1/16

[52] U.S. Cl. ..... 340/735; 340/748; 340/731

[58] Field of Search ..... 340/735, 709, 703, 790, 340/731, 748

[56] References Cited

U.S. PATENT DOCUMENTS

| | | | |
|---|---|---|---|
| 3,638,216 | 1/1972 | Brewster | 340/735 |
| 3,678,497 | 7/1972 | Watson et al. | 340/735 |
| 3,868,673 | 2/1975 | Mau, Jr. et al. | 340/709 |
| 4,028,695 | 6/1977 | Saich | 340/709 |
| 4,555,701 | 11/1985 | Dahl et al. | 340/736 |

*Primary Examiner*—Gerald L. Brigance

*Attorney, Agent, or Firm*—J. Michael Anglin

[57] ABSTRACT

A display attribute, such as normal/reverse video, automatically switches between two different, separately optimizable character fonts. One font is complementary to the other.

6 Claims, 3 Drawing Figures

LEGIBILITY ENHANCEMENT FOR ALPHANUMERIC DISPLAYS

BACKGROUND OF THE INVENTION

The present invention relates to data displays, and more specifically concerns apparatus and methods for increasing the legibility of characters having different display attributes or modes.

Many present data-processing displays allow alphanumeric character images to be presented with different display attributes, such as highlighting, blinking, and normal/reverse. A "display attribute" is a visible aspect of a character image which exists independently of the identity of the character. For the normal/reverse attribute, images are selectively displayed as either bright characters on a dark background (normal mode) or as dark characters on a bright background (reverse mode).

Conventional practice with respect to the normal/-reverse attribute, for both cathode-ray tube (CRT) and other displays, merely inverts a binary video signal to switch between normal and reverse modes. If a binary "1" represents a bright dot and a "0" represents a dark space, then the ones and zeros of the video signal for the normal mode are merely inverted by a simple logic circuit to obtain the reverse-mode video signal.

Mere inversion of the video signal makes the reverse-mode characters more difficult to read. In CRT displays, the problem is compounded because the CRT itself makes dark dots appear less wide than bright dots having the same time duration. This problem has been solved by time-stretching the (dark) character-image dots in reverse mode more than the (bright) character-image dots of the normal mode, as described in copending commonly assigned U.S. Pat. No. 4,555,701, patented Nov. 26, 1985 by R. E. Dahl et al.

The legibility problem, however, goes deeper than merely making reverse-mode characters appear the same as the corresponding normal-mode characters. Even when the physical properties of the display are compensated for, it has been found that a character font which is highly legible in normal mode is less easily legible in reverse mode, and vice versa. In the prior art, therefore, a designer had to optimize a character font for one mode—usually normal mode—and accept less readability in the other mode, or compromise the font design and detract from both modes.

In an environment where ever larger numbers of people spend increasing amounts of time at data displays, especially for long continuous intervals, even apparently small changes in font design can greatly enhance legibility. This in turn can reap great rewards of operator comfort, happiness, and even health.

SUMMARY OF THE INVENTION

The present invention improves the ergonomic aspects of alphanumeric data displays by allowing the images of individual characters to be separately optimized in an arbitrary manner for different modes of a display attribute in what would otherwise be a single character font. The cost of implementing the invention in an otherwise conventional display terminal is very low, easily affordable in even inexpensive products.

Broadly speaking, the invention uses a display-attribute signal itself to switch between two different character fonts automatically, each font being separately optimizable for its own display attribute. One of the fonts may be produced from the other by changing the number and location of the dots in the individual character images by means of logic circuits switched by a normal/reverse mode specification in an attribute signal.

DETAILED DESCRIPTION

Figure 1:
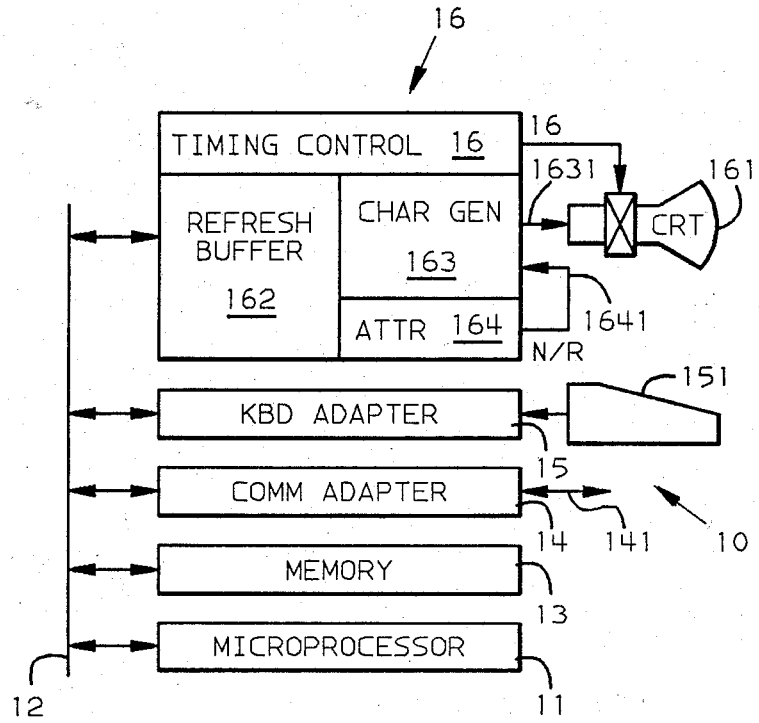
FIG. 1 is a block diagram of a display terminal incorporating the present invention.

FIG. 1 is a high-level block diagram illustrating a type of alphanumeric display terminal 10 in which the present invention may find utility.

Microprocessor 11 controls the remaining units via conventional address/data/control bus 12. Memory 13 contains read-only memory (ROM) for holding various conventional operating programs, and also contains read/write memory (RAM) for storing data. Communications adapter 14 manages a data-transmission protocol with a data processor or other device over line 141. Keyboard adapter 15 interfaces a standard alphanumeric keyboard 151.

Display adapter 16 includes units for presenting a screen of characters to a raster-scanned CRT 161. The CRT may be replaced by any other display component, such as a plasma display (not shown), which produces character images as a matrix of individual dots having bright and dark values. Refresh buffer memory 162 sends character codes sequentially to character generator 163, which converts them to a series of timed digital signals having ON (bright) and OFF (dark) levels on line 1631. Attribute decoder 164 converts further data in buffer 162 into signals representing specific display attributes, such as highlighting, blinking, and normal/-reverse (N/R) video modes. Typically, an attribute byte contains a separate bit for each attribute, the value of each bit specifying the state of that particular attribute, independently of the others. The N/R mode signal may comprise one bit of such an attribute byte. "Normal" mode presents the characters as bright or phosphor-active (white, green, amber, etc.) on a dark background. "Reverse" mode has dark or phosphor-inactive ( black, etc.) characters on a bright background. The binary-valued N/R mode signal appears on line 1641. Timing control 165 produces signals for generating raster scan lines on CRT 161. All of the units of display adapter 16 are conventional, except for a portion of character generator 163.

Figure 2:
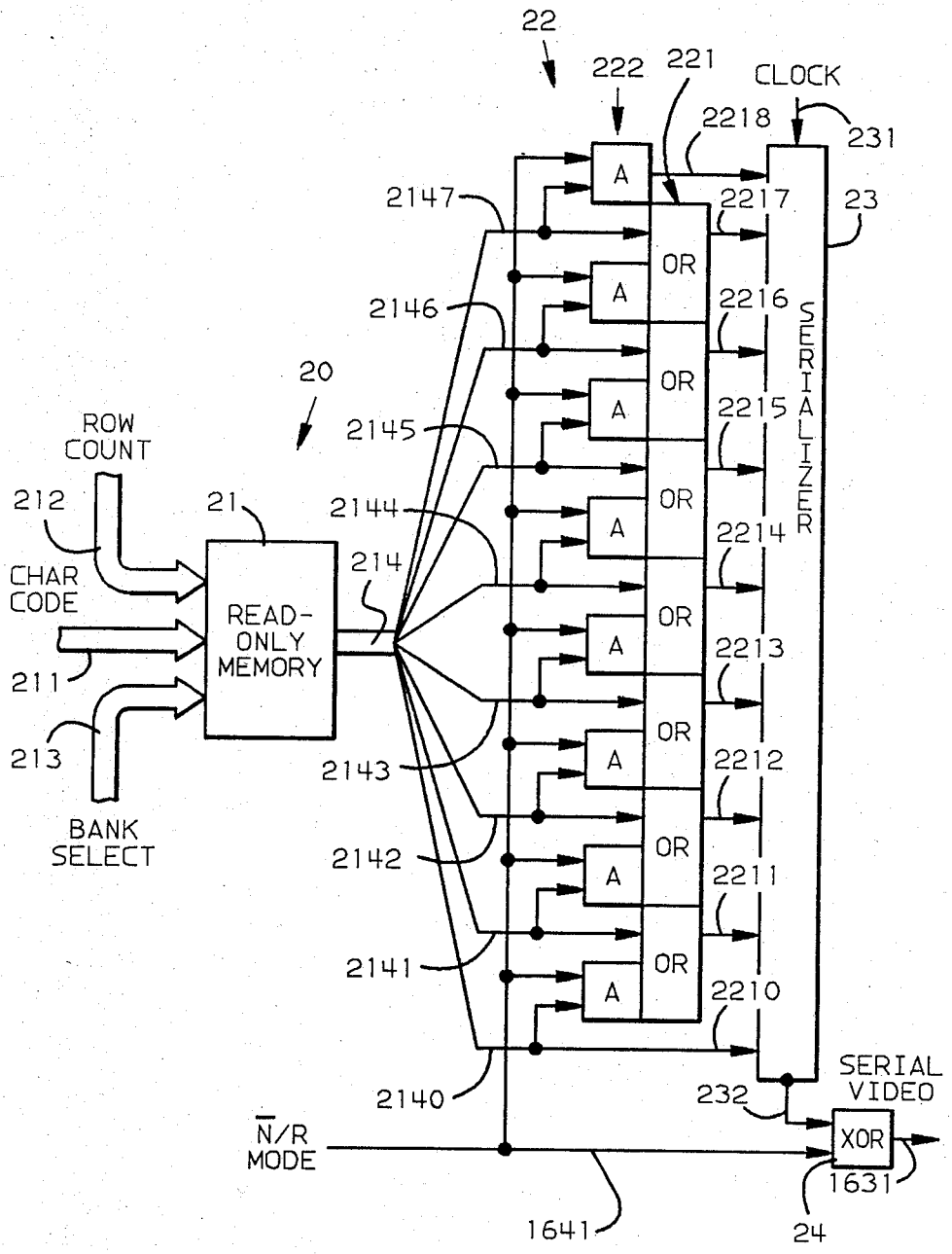
FIG. 2 is a logic diagram of a character generator according to the invention.

FIG. 2 shows the portion 20 of character generator 163, FIG. 1, which is relevant to the present invention. Conventional ROM 21 stores each dot of each character image as ones and zeros corresponding to the character pattern itself and the background area, respectively. Typically, ROM 21 stores eight-bit words. In this case, every addressable location holds all the dots for a single horizontal scan line of one character image. The addresses for this ROM are determined by a character code 211 from refresh buffer 162 (FIG. 1) and a cyclic horizontal-scan-line count 212 from timing control 167. If ROM 21 has enough capacity, additional character fonts, such as foreign-language or special-symbol character sets, may also be included by providing additional address bits 213 within adapter 16 from any convenient source.

Logic gates 22 produce a video signal corresponding to different first and second character fonts when switched by a Normal/Reverse mode signal 1641 from attribute unit 164 (FIG. 1). A "0" level of signal 1641 indicates a Normal mode, in which ROM 21 directly produces the font to be displayed. To accomplish this, a bank of OR gates 221 passes the ROM-output dot signals 2141–2147 unchanged to lines 2211–2217. The leftmost bit, 2140, passes directly to line 2210. A ninth line, 2218, represents the rightmost dot in the character-image row; it is always off—i.e., dark —in the Normal mode. A tenth dot position to the right of this dot logically defines the intercharacter space in the character box. Since it is dark at all times, it does not have an external signal line. A "1" value on signal line 1641 indicates Reverse mode. This switches on AND gates 222, which produce the Reverse font by forcing to "1" each bit directly to the right of a "1" bit in the Normal font. This increases the width of all character strokes by one dot, without affecting stroke height. At the right edge of the character, line 2218 provides one dot which is never on in the Normal mode. The visual effect, however, is that both the Normal and Reverse characters are substantially the same size, even though Reverse-mode characters can be one dot—about 12% in this example—wider than Normal-mode characters. The pitch, or character-to-character spacing, of the characters remains the same in both modes, of course.

Conventional serializer 23 converts the nine bits of a parallel character slice on lines 2210–2218 to a serial video signal 232 timed by dot clock 231 from timing control 165 (FIG. 1). The tenth, intercharacter space dot position is always off. This effect may be accomplished in any known manner, such as a tenth serializer bit position (not shown) strapped to ground. Serial signal 232 contains a "1" bit for each dot belonging to the character image and a "0" bit for each dot in the background of the box containing the character image.

The video signal is then modified or altered to present the image in accordance with the state of the attribute signal. When N/R signal 1641 is low to activate Normal mode, exclusive-OR (XOR) gate 24 passes signal 232 unchanged to video output 1631, so that the "1" bits are displayed as bright dots on the CRT; thus, the character image is bright on a dark background. But, when N/R signal goes high to activate Reverse mode, XOR 24 inverts signal 232, so that the character appears on the CRT as a dark image on a bright background.

Figure 3:
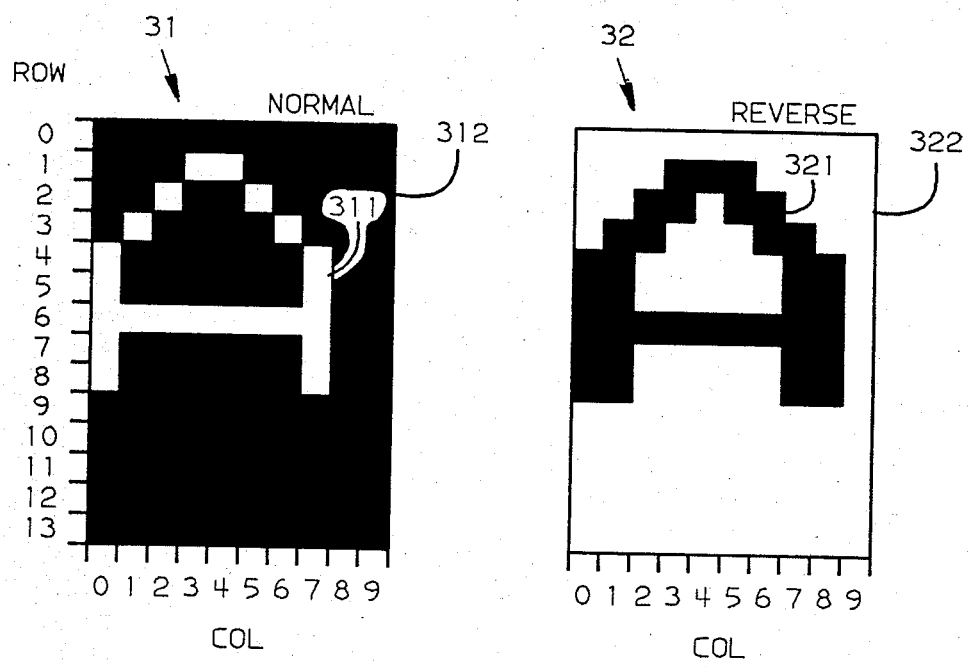
FIG. 3 illustrates the appearance of certain character images according to the invention.

FIG. 3 illustrates at greatly enlarged scale a Normal-mode character 31 and a corresponding Reverse-mode character 32 according to the invention. Normal-mode character 31 comprises a bright image 311 eight dot rows high (rows 1–8) by eight dot columns wide (columns 0–7) placed inside a dark box 312 fourteen dot rows high (rows 0–13) by ten dot columns wide (columns 0–9). Columns 8 and 9 represent the intercharacter space, and are always dark. Vertical strokes as well as horizontal strokes in the image are a single dot wide. Reverse-mode character 32 comprises a dark image 321 occupying dot rows 1–8 and dot columns 0–8, in the same eight-by-fourteen-dot box as that of character 31. The background area 322 of character 32 is bright. Image 321 is conceptually derived by superimposing a copy of image 311, shifted one dot to the right, on the original image 311, then reversing the image from bright to dark. Column 9 alone now represents the intercharacter space. This increase in overall image width does not substantially affect perceived size: the overall character pitch or spacing remains the same, and bright lines tend to appear thicker than dark lines of the same physical width. Reverse-mode image 321 is thus displayed in a double-dotted font in which vertical and diagonal character strokes are two dots wide, while horizontal strokes remain one dot wide.

Modifications of this exemplary implementation within the spirit and scope of the invention will be obvious to those skilled in the art. In FIG. 1, terminal 10 may, of course, be replaced by any other type of display for alphanumeric characters. The benefits of the invention are not limited to CRT displays, but apply as well to plasma or other display technologies. In FIG. 2, other methods of producing a different Reverse-mode font from a Normal-mode font (or vice versa) are possible. For example, the single-dotted Normal font could be converted to a triple-dotted reverse font, or a double-dotted Normal font to a triple-dotted Reverse font, and so forth. It is even possible to do away with logic 22 entirely, and to store two completely different fonts for the two modes. These fonts could then be called up independently by including N/R mode signal 1641 as one line of font-selection lines 213; this would allow arbitrary differences between Normal and Reverse modes of what would otherwise be the same character font. Fonts could also be switched automatically in the same manner for other display attributes, such as Intensified; for example, it might be advantageous to display intensified (highlighted) characters in a different font than that used for characters displayed at normal or dimmed intensity. In FIG. 3, the style, size, placement, and other details of the particular character boxes and images can of course be changed to suit individual requirements.

We claim:

1. Apparatus for enhancing the legibility of character images of a display for alphanumeric character images made up of a matrix of individual dots having character generating means for producing a video signal having first and second levels, and having attribute means for producing an attribute signal specifying a display attribute having first and second modes, the improvement comprising:

first generator means in said character generator means for producing a first font of character shapes;

second generator means in said character generator means for producing a second font of character shapes, said second font having substantially the same overall size as said first font and being complementary thereto; and, logic means resopnsive to said attribute signal for producing said video signal from said first font of character shapes when said atrribute signal is said first mode and for producing said video signal from said second font of characteer shapes when said attribute signal is in said second mode.

2. A display acording to claim 1, wherein said attribute signal is capable of specifiying said first mode as a normal mode in which said first video-signal level represents said character images and is also capable of specifying said secodn mode as a reverse mode in which said second video-signal level represents said character images.

3. A display according to claim 2, wherein said first generator means comprises a memory storing dot matrix patterns defining said first font.

4. A display according to claim 3, wherein said second generator means comprises generator logic means to modify predetermined dots in said first font so as to produce said complementary second font.

5. A method for enhancing the legibility of character images on a display means, comprising the steps of:

generating each of said images as a sequence of dots in a video signal having plural levels to enable display of character images at plural levels on plural backgrounds;

decoding the mode of an attribute signal having a plurality of modes specifying which of said levels represents said images and which of said levels represents said backgrounds;

modifying the number and location of said dots representing said images at one of said plural levels in response to decoding said attribute signal in one mode of said plural modes and leaving the number and location of said dots representing said images at another one of said plural levels unchanged in response to decoding said attribute signal in another mode of said plural modes.

6. A method according to claim 5, wherein the number of said dots is modified by adding a dot horizontally to one side of any dot representing said images unchanged.

* * * * *